United States Patent [19]

Knauth

[11] 4,023,982

[45] May 17, 1977

[54] APPARATUS FOR THE PRODUCTION OF SUGARS FROM HEMI-CELLULOSE-CONTAINING RAW MATERIALS

[75] Inventor: Hans H. Knauth, Ravensburg, Germany

[73] Assignee: Sulzer Brothers Limited, Winterthur, Switzerland

[22] Filed: Dec. 1, 1975

[21] Appl. No.: 636,743

[30] Foreign Application Priority Data

Dec. 3, 1974 Switzerland ..... 15999/74

[52] U.S. Cl. ..... 127/1; 23/270 R; 127/37

[51] Int. Cl.[2] ..... C13K 1/02; C13K 13/00

[58] Field of Search ..... 127/1, 37; 23/270 R

[56] References Cited

UNITED STATES PATENTS

| | | | |
|---|---|---|---|
| 2,508,884 | 5/1950 | Hereng | 127/1 X |
| 2,739,086 | 3/1956 | Wallace | 127/37 X |
| 2,801,939 | 8/1957 | Hignett | 127/37 |
| 3,251,716 | 5/1966 | Porter | 127/37 |
| 3,479,248 | 11/1969 | Nobile | 127/37 X |
| 3,523,911 | 8/1970 | Funk | 127/37 X |
| 3,787,241 | 1/1974 | Eickemeyer | 127/37 X |

*Primary Examiner*—Sidney Marantz
*Attorney, Agent, or Firm*—Kenyon & Kenyon Reilly Carr & Chapin

[57] ABSTRACT

The apparatus operates on a continuous basis under gravity flow to extract sugars from hemi-cellulose-containing raw material such as xylose from xylan-containing raw materials. The apparatus includes a sequence of interconnected vessels to steam heat the raw material, to acid-impregnate the steam-heated material, to hydrolyze the acid-impregnated material with steam and to extract sugar and other particles from the hydrolyzed material with a counter-flow of hot water. A conveyor is used in the acid impregnating vessel to move the material to the reaction vessel. The hydrolyzed material is stored in a tank while the residue of raw material is removed in a non-destroyed state.

12 Claims, 5 Drawing Figures

ACID
STEAM
HOT WATER
II
III
IV
V

APPARATUS FOR THE PRODUCTION OF SUGARS FROM HEMI-CELLULOSE-CONTAINING RAW MATERIALS

This invention relates to an apparatus for the production of sugars from hemi-cellulose-containing raw materials. More particularly, this invention realtes to an apparatus for the production of xylose from xylan-containing raw materials.

Heretofore, it has been known to produce sugar from hemicellulose, for example to produce xylose from xylan-containing raw materials, by bringing the raw materials and an acid solution into contact in a closed vessel under elevated temperature and pressure, so that hydrolysis occurs. The resultant sugar, e.g. xylose, is then extracted with water.

The disadvantage of this apparatus is that impregnation, reaction (hydrolysis) and frequently extraction take place together. The control and optimization of the individual stages is thus rendered very difficult or even impossible.

Another great disadvantage is that the raw materials are only partly vented. This causes an excess pressure of both the air and steam in the raw material pores. As a result, the capillary absorption of the hot acid solution into the pores of the raw material is made very difficult and complete impregnation of the raw meterials with an acid solution is therefore impossible. This, in turn, results in leaving only a small reaction surface available between the raw materials and the acid solution so that the hydrolysis of the xylan contained in the raw materials occurs in a slow uncontrollable manner. With known apparatus, therefore, the process takes a considerable amount of time and is not very economic. Also, the degree of purity of the resulting sugar solution is not high nor is it constant.

Another disadvantage is that such an apparatus is not suitable for processing large quantities of raw materials such as are required for the production of large quantities of sugar.

Accordingly, it is an object of the invention to provide an apparatus which operates economically by allowing the operations in the various stages of the process to be accurately controlled and optimized, so that the process time is short and the purity of the product is very high and constant.

It is another object of the invention to provide an apparatus for a continuous production of sugar from hemi-cellulose-containing raw material.

It is another object of the invention to increase the production of sugars from hemi-cellulose-containing raw material.

It is another object of the invention to optimize the amount of reaction surface in the pores of a hemi-cellulose-containing raw material for hydrolysis in the production of a sugar.

It is another object of the invention to extract sugar from a raw material without destroying the raw material.

Briefly, the invention provides an apparatus for the production of sugars from hemi-cellulose-containing raw materials on a continuous and gravimetric basis. The apparatus includes a venting vessel, an impregnating vessel, a reaction vessel, an extraction vessel and a conveyor in the impregnating vessel for conveying the raw material to the reaction vessel.

The venting vessel receives a flow of the raw material and steam while the impregnating vessel is located downstream of the venting vessel for impregnating the flow of raw material with acid. The reaction vessel is downstream of the impregnating vessel for steam-heating the flow of acid-impregnated raw material received via the conveyor in order to hydrolyze the raw material. The extraction vessel is, in turn, downstream of the reaction vessel for passing hot water in counter-flow to the hydrolyzed raw materal to extract a sugar from the hydrolyzed raw material and to form a hydrolysis product of the hot water and sugar.

The apparatus also includes a storage tank to receive the hydrolysis product and a removal means for removing the residue of raw material.

During operation, the movement of the raw material between the venting vessel and the impregnating vessel, and between the impregnating vessel, the reaction vessel and the extraction vessel, takes place continuously and by gravity. Preferably, the conveyor is a screw conveyor so disposed between a bottom zone of the impregnating vessel and a top zone of the reaction vessel that the conveying axis of the screw conveyor rises in the direction of the reaction vessel.

In order to remove the extraction product, i.e. the hydrolysis product, the top zone of the extraction vessel and the bottom zone of the reaction vessel form an annular chamber so dimensioned that the speed of the upward flow of the extraction product therein is less than the sedimentation speed of the material particles.

In order to prevent the level of extraction water in the extraction vessel from falling, the extraction vessel is connected to an overflow means in liquid-communicating relationship.

A flow connection for steam is provided between the top zone of the reaction vessel and the bottom zone of the venting vessel, so that the steam flowing through the reaction vessel can then be used in the venting vessel.

These and other objects and advantages of the invention will become more apparent from the following detailed description and appended claims taken in conjunction with the accompanying drawings in which:

FIG. 1 schematically illustrates an apparatus in accordance with the invention;

Figure 1:
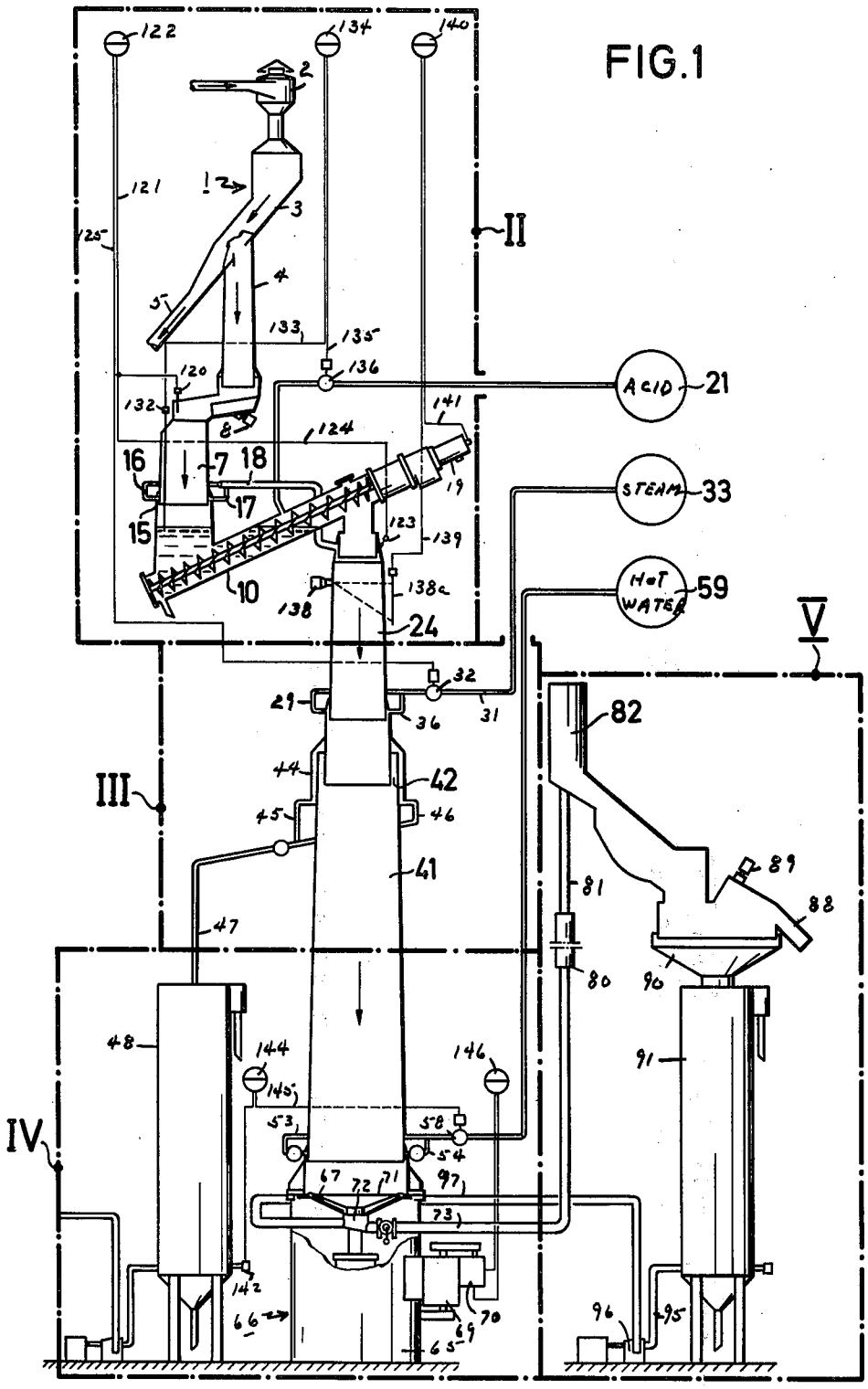

Referring to FIG. 1, the apparatus includes a feeder 1 which receives a flow of hemi-cellulose-containing raw material from a conveyor (not shown), a venting vessel 7, an impregnating vessel 10, a reactor vessel 24 and an extraction vessel 41.

Figure 2:
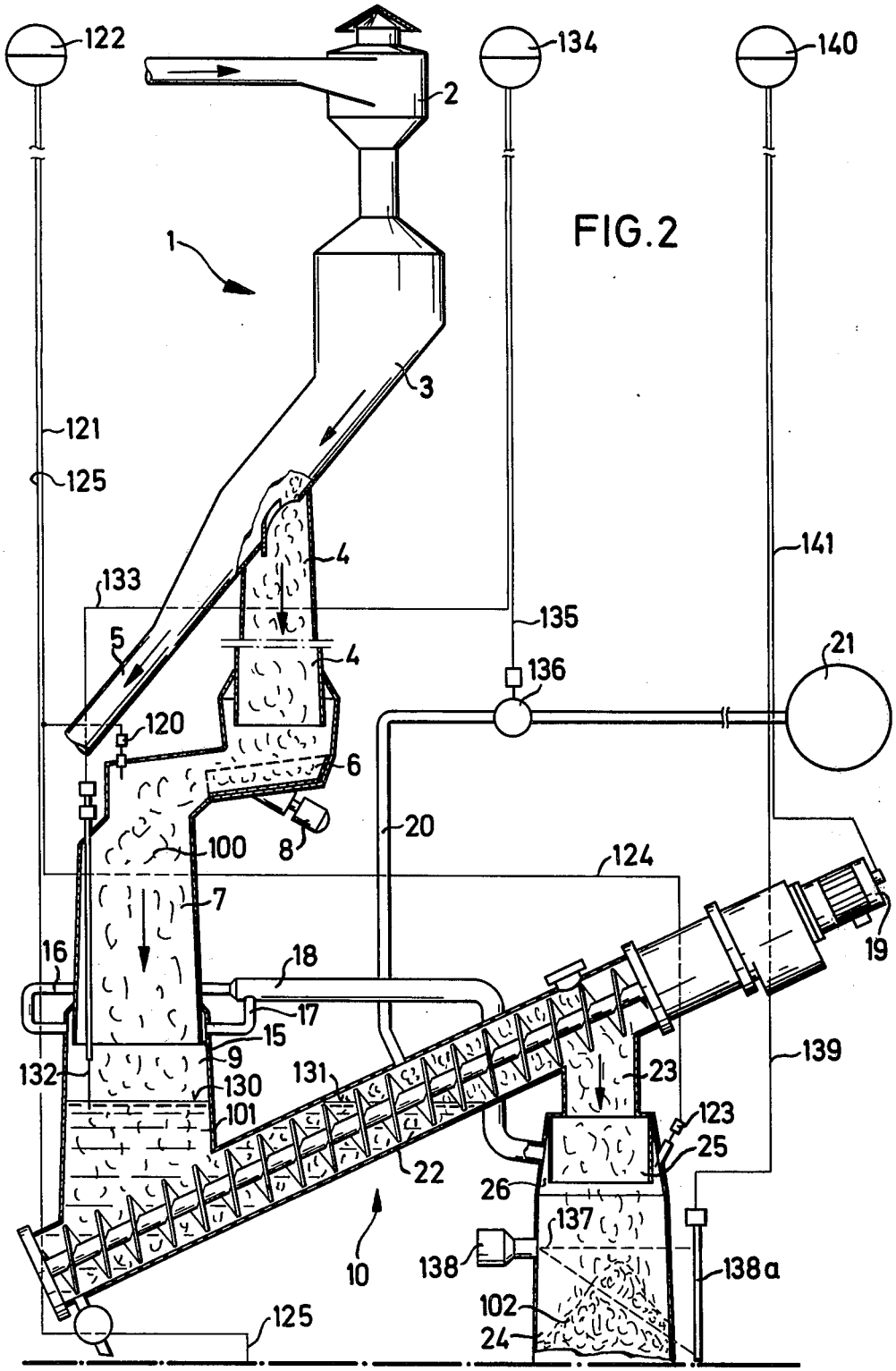
FIG. 2 illustrates an enlarged view of a part II of FIG. 1 showing the venting vessel, impregnating vessel and top zone of the reaction vessel, in accordance with the invention.

Referring to FIGS. 1 and 2, the feeder 1 consists of a cyclone 2, an inclined chute 3 and a vertical filler tube 4. The chute 3 is provided with an extension 5 which acts as an overflow for the raw material introduced. The filler tube 4 terminates above a shaking trough 6 (FIG. 2) which terminates above the venting vessel 7. The shaking trough 6 is driven by a motor 8 mounted on the underside of the tube 4.

The venting vessel 7 is mounted on a box 9 which forms a part of the impregnating vessel 10 and is disposed to receive the flow of raw material from the filler tube 3 via the trough 6.

The inpregnating vessel 10 is located downstream i.e. below, as shown, of the venting vessel and includes a conveyor in the form of a screw conveyor. The screw conveyor extends between a bottom zone of the impregnating vessel 10 and a top zone of the reaction vessel 24 on an inclined angle so as to convey acid impregnated raw material upwardly from the bottom zone of the impregnating vessel 10 to the top zone of the reaction vessel 21. The screw conveyor is driven by a motor 19. Alternatively, some other conveyor may be provided instead of a screw conveyor, for example a chain conveyor. Also, the conveyor may be situated outside the impregnating vessel. A means for supplying acid to the impregnating vessel 10 is in the form of an acid supply tank 21 which is connected via a conduit 20 to an intermediate part of a tube 22 forming a part of the vessel 10 housing the screw conveyor.

As shown in FIG. 2, an annular chamber 15 is formed between the venting vessel 7 and the box 9 of the impregnating vessel 10. A means for supplying steam into the venting vessel 7 to penetrate into the pore system of the raw material is connected to this chamber 25. To this end, the steam supply means includes two branch conduits 16, 17 which communicate with the chamber and a common conduit 18 which communicates with the branch conduits 16, 17 to deliver steam thereto.

Figure 3:
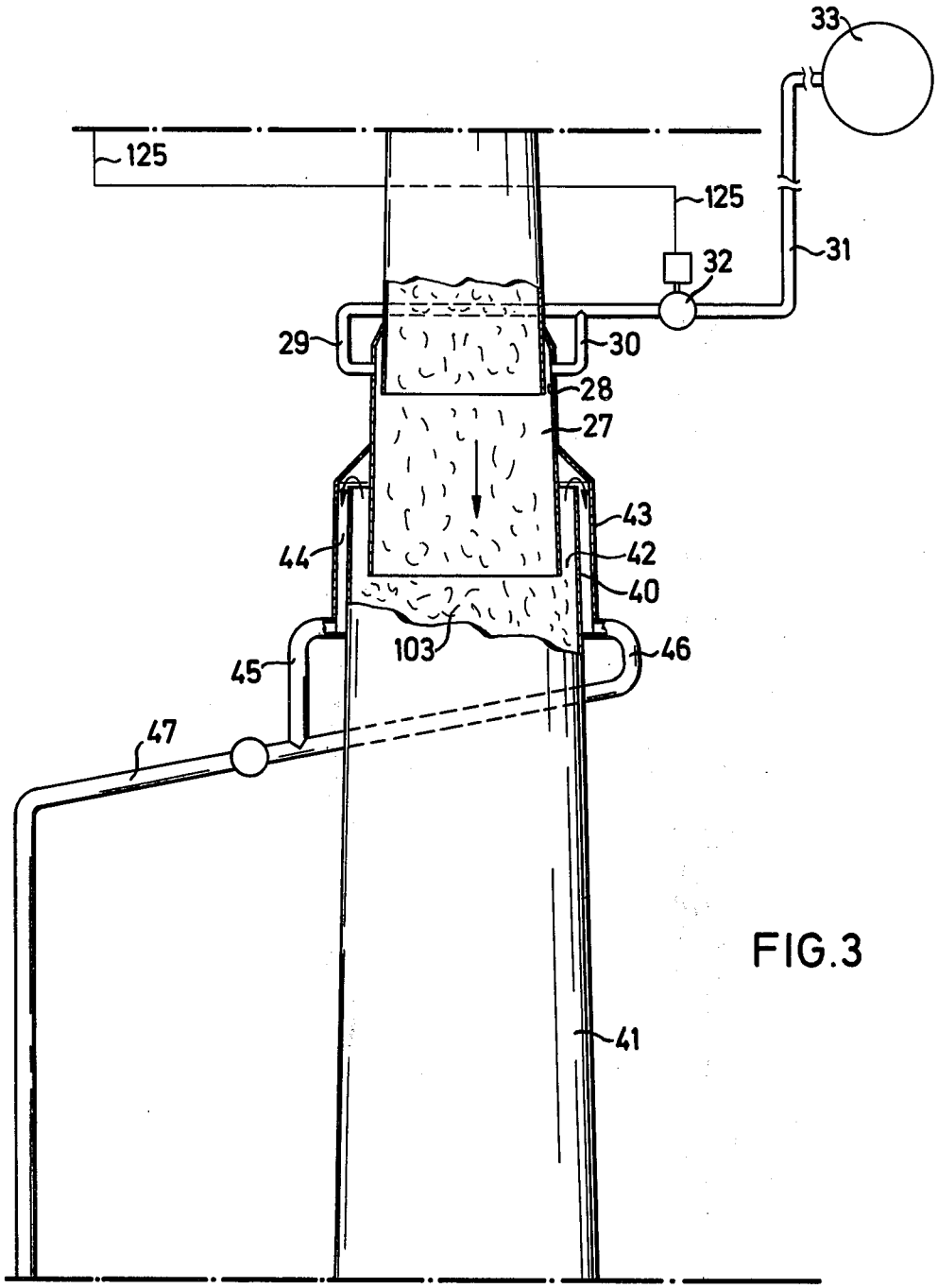
FIG. 3 illustrates an enlarged view of FIG. 1 of a part III of FIG. 1 showing the bottom zone of the reaction vessel and the top zone of the extraction vessel in accordance with the invention.

The end of the tube 22 of the screw conveyor is connected to the feed side 23 of the reaction vessel 24 which is below the impregnating vessel 10. At the top zone, the reaction vessel 24 has a smaller-diameter cylindrical part 25 so that an annular chamber 26 forms between the part 25 and reaction vessel wall. As shown in FIGS. 1 and 3, the reaction vessel 21 terminates in the bottom zone in a larger-diameter cylindrical part 27, so that an annular space 28 is likewise formed between the reaction vessel 21 and a top zone of the extraction vessel 41 which is below the reaction vessel 21.

Referring to FIG. 3, a means is provided for supplying steam into the reaction vessel 24 in order to hydrolyze the acid-impregnated raw material therein. As shown, this steam supply means includes a steam tank 33 which is connected via a conduit 31 containing a control valve 32 to two branch conduits 29, 30 which, in turn, communicate with the chamber 28 between the reaction vessel 24 and extraction vessel 41. As shown in FIGS. 1 and 2, the conduit 18 for delivering steam to the venting vessel 7 is connected to the chamber 25 in the top zone of the reaction vessel 24 so that the tank 33 serves as the steam supply for both the venting vessel 7 and reaction vessel 24.

Figure 4:
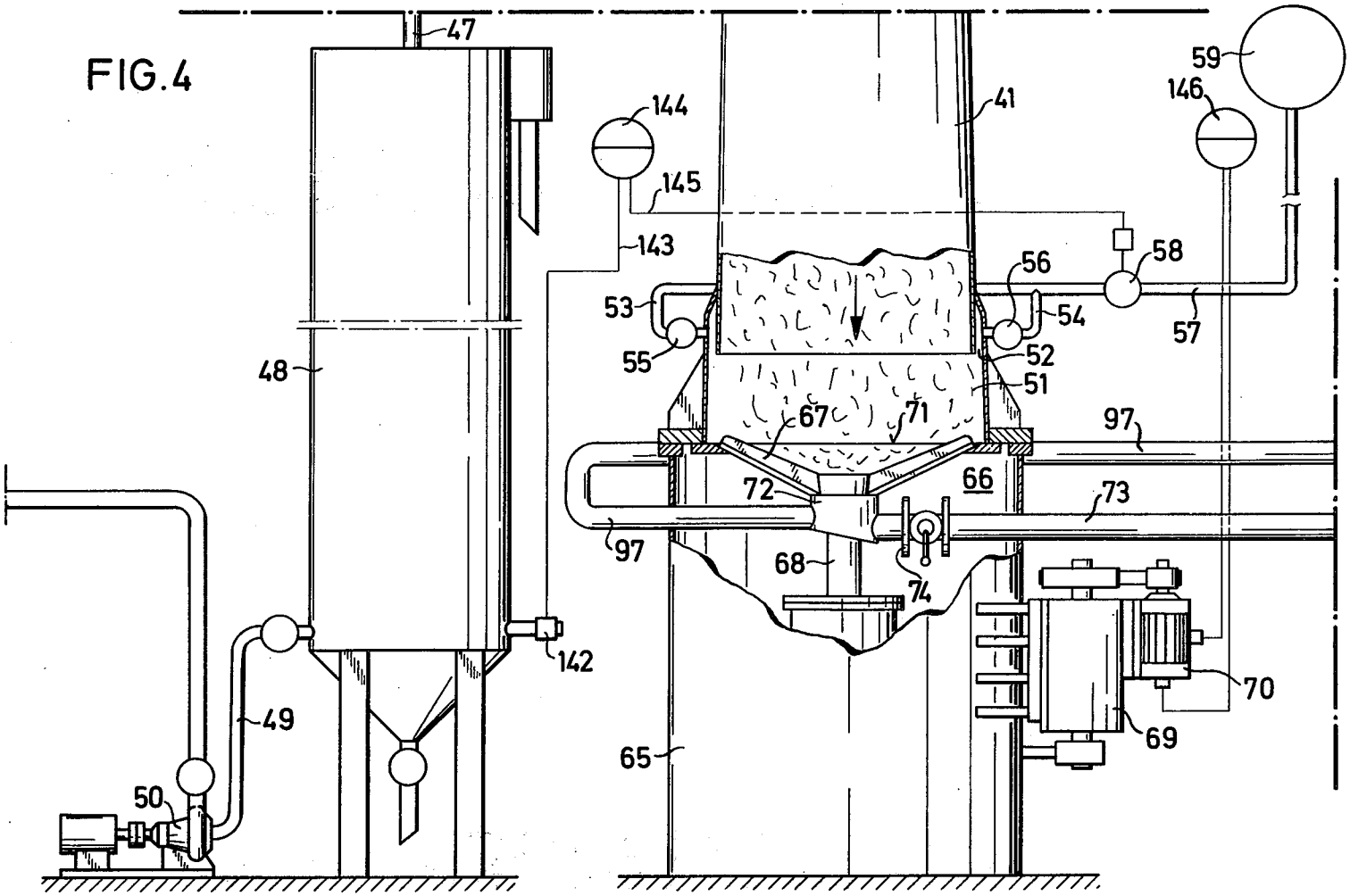
FIG. 4 illustrates an enlarged view of FIG. 1 of a part IV of FIG. 1 showing the extraction vessel and storage tank in accordance with the invention.

Referring to FIG. 4, the bottom zone of the reaction vessel 24 has a cylindrical part 27 which is introduced into the top zone 40 of the extraction vessel 41, so that an annular chamber 42 is formed between the two. The top zone of the extraction vessel 41 is also surrounded by a cylindrical part 43, which forms a further annular chamber 44 therebetween. This latter chamber 44 is closed at the bottom and is connected, via two branch conduits 45, 46 at the bottom which merge into a common conduit 47 containing a valve, to a storage tank 48.

A conduit 49 containing a pump 50 leads from the tank 48 to other apparatus (not shown) for further processing of the hydrolysis product stored in the tank 48.

A means is provided for supplying hot water to the extraction vessel 41 in counterflow to the hydrolyzed raw material. This means, as shown in FIG. 4, includes a hot water supply tank 59 which is connected via a conduit 57 containing a control valve 58 and two branch conduits 53, 54 each of which contains control valves 55, 56. As shown, the bottom zone of the extraction vessel 41 merges into a larger-diameter cylindrical part 51 so that an annular chamber 52 forms therebetween. This annular chamber communicates with the two conduits 53 and 54 of the hot water supply.

The extraction vessel 41 rests on a housing 65 for a removal means 66 equipped with agitator blades 67. As shown, the removal means 66 includes a shaft 68 which carries the blades 67 and is driven by a motor 70 via a transmission 69. The blades 67 extend as far as the bottom 71 of the extraction vessel 41 while the shaft 68 extends through a cylindrical chamber 72 into which a conduit 73 leads. The conduit 73 extends to an overflow means 82 (FIGS. 1 and 5) via a flexible intermediate conduit 80 and an overflow conduit 81.

Figure 5:
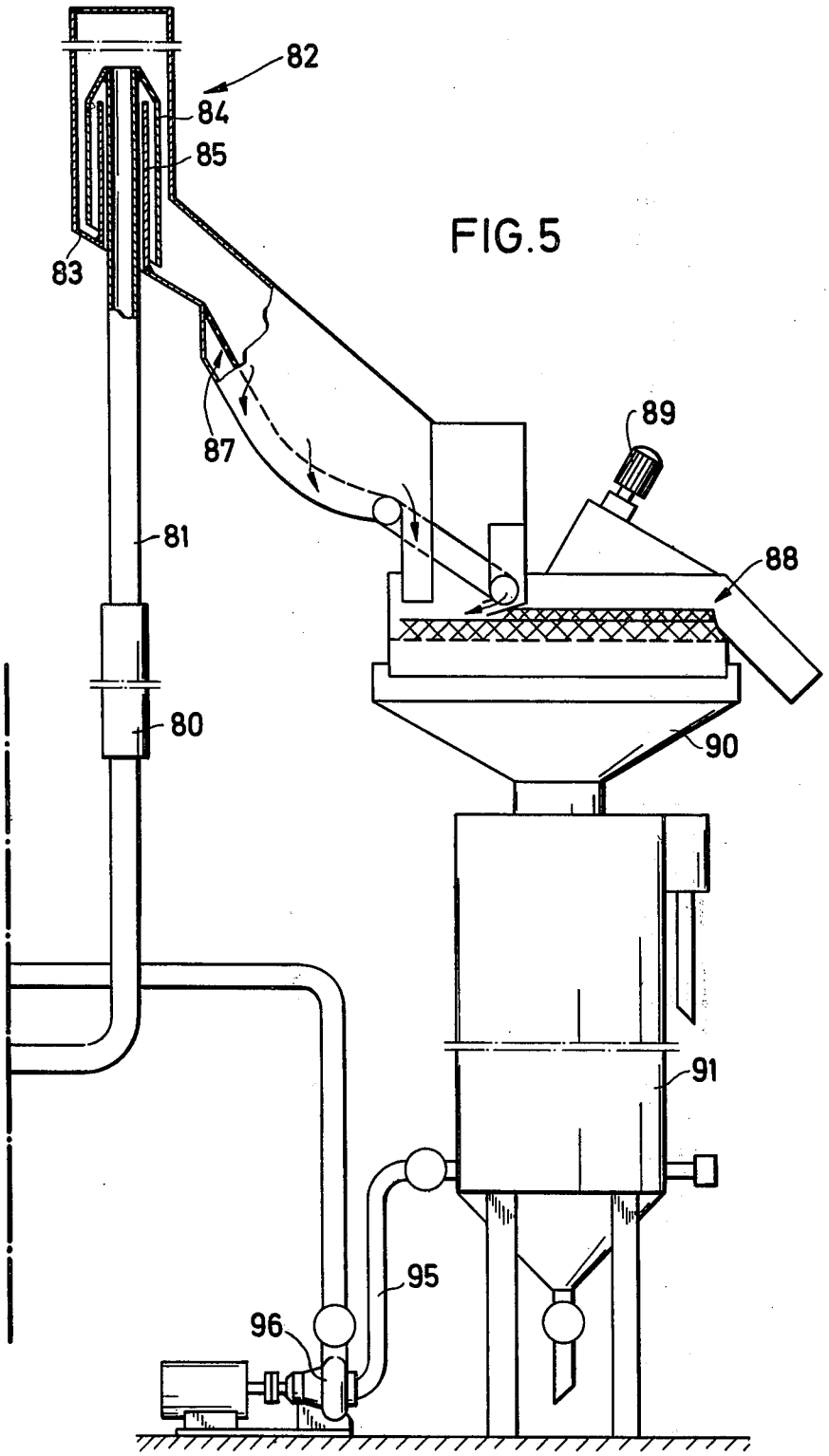
FIG. 5 illustrates an enlarged view of FIG. 1 of a part V of FIG. 1 showing the overflow means which is connected to the extraction vessel in accordance with the invention.

As shown in FIG. 5, the overflow conduit 81 extends through the base 83 of the overflow means and is provided with a shield 84 at the end. A tube 85 connected to the base 83 extends between the shield 84 and the overflow conduit 81. The overflow means is followed by a screen 87 which terminates above a vibratory screen 88 driven by a motor 89. A hopper 90 is located beneath the vibratory screen 88 and rests on a tank 91. The tank 91, in turn, communicates with the cylindrical chamber 72 of the removal means 66 via a conduit 95 containing a pump 96.

The apparatus operates as follows:

The pre-comminuted raw material, e.g. beech chips of a size equivalent to half a matchstick, enters the cyclone 2 (FIGS. 1 and 2) in which the air is separated. The raw material then falls from the cyclone 2 through the chute 3 and the filler tube 4 while being heated to a temperature of 100° C and passes to the shaking trough 6. The raw material is compacted on the through 6 and fed to the venting vessel 7.

In the venting vessel 7, the raw material is added to the saturated steam fed via the conduits 18, 16 and 17 and the annular chamber 15. The saturated steam is delivered from the steam tank 33 and flows through the conduits 31, 29, 30 and the annular chamber 28 to the reaction vessel 24, through the latter, the conduits 18, 16 and 17, and the annular chamber 15, to the venting vessel 7. The saturated steam penetrates into the pore system of the raw material in the venting vessel, mainly by capillary action, and in so doing displaces the air in the pores. The expelled air leaves the apparatus through the filler tube 4, chute 3 and cyclone 2. The venting of the raw material by means of the steam thus takes place at about 100° C and at atmospheric pressure.

The vented column of raw material 100 in the venting vessel 7 drops under gravity continuously downwards to the bottom zone of the vessel 7 and into the acid 101 which is present there and in the screw conveyor. Since the acid is at a much lower temperature than the vented and heated raw material, the saturated steam in the raw material pores condenses, so that a negataive pressure occurs in the pores. Consequently, the pores absorb the acid rapidly and are completely filled therewith. The subsequent reaction (hydrolysis) of the raw material in the reaction vessel 24 thus takes place rapidly and thoroughly.

The acid-impregnated raw material is continuously discharged from the surplus acid 101 and fed to the reaction vessel 24 by the screw conveyor under gravity. The acid-impregnated column of raw material 102 is then heated in the reaction vessel 24 to the required reaction temperature by the steam flowing at a pressure of about 2 atmospheres gauge from the tank 33 into the reaction vessel 24 via the conduits 31, 29 and 30 and the annular chamber 28 (FIGS. 1 and 3). The acid thus acts as a catalyst for the hydrolysis of the raw material to from xylose, which is completely dissolved in the acid contained in the raw material. The excess steam flows through the entire column of raw material in the reaction vessel 24 and leaves via the conduit 18 to flow through the conduits 16, 17 and the annular chamber 15 into the venting vessel 7. The steam is then used in the venting vessel 7 for heating and venting the column of raw material 100 as described above.

The column of raw material 102 (FIG. 2) hydrolyzed in the reaction vessel 24 falls continuously downwards under gravity into the extraction vessel 41 to form a column of material 103. Hot water at a temperature of about 90° C is continuously fed from the tank 59 into the extraction vessel 41 via the conduits 57, 53 and 54 and the annular chamber 52 as so to flow upwardly through this column of material 103 in the extraction vessel 41. The water and the column of material 103 thus flows in countercurrent. The substances contained in the material particles, such as xylose, acetic acid and other extracts, diffuse out and dissolve into the hot water. The upwardly flowing water (the hydrolysis product) which has become continuously concentrated with these substances on the way, leaves the extraction vessel 41 (FIGS. 1 and 4) through the annular chambers 42, 44 and flows to the storage tank 48 via the conduits 45, 46 and 47. This tank 48 acts as an intermediate store for the hydrolysis product which can be fed by the pump 50 via the conduit 49 to other apparatus (not shown) for separating solids from the hydrolysis product, and to a crystallization apparatus for the recovery and purification of the xylose.

Referring to FIG. 3, the annular chamber 42 between the top zone of the extraction vessel 41 and the bottom zone of the reaction vessel 24 is so dimensioned that the speed of the hydrolysis product flowing upwardly therein is less than the sedimentation speed of the material particles in the annular chamber 42. This prevents material particles from being discharged with the hydrolysis product and entering the storage tank 48.

Referring to FIG. 4, the part of the column of material 103 in the bottom zone of the extraction vessel 41 is continuously removed by the agitator blades 67 of the removal means 66. During this time, the residue or material particles pass to the cylinder chamber 72 through which water flows from the conduit 97 and entrains the material particles and discharges them through the riser 73. The material suspension then passes (FIG. 5) via the overflow conduit 81 to the overflow means 82. The overflow means 82 and the extraction vessel 41 thus form an adjustable communicating system so that the level of the hot water in the extraction vessel 41 is maintained constant. The material suspension flows out of the overflow means on to the screen 87 so that the water and particles can be separated. The water then flows through the hopper 90 into the tank 91. The pump 96 delivers the water from this tank 91 back to the removal means 66 of the extraction vessel 41 for further conveyance of the material particles from the vessel 41 as described above.

It will be apparent from the foregoing description that there is a completely continuous flow through the separate process stages so that the apparatus is very economic and the end product has a high purity. Further, each process stage can be separately controlled in an accurate manner and optimized. The speed of operation of the removal means 66 is so selected that the process stages, i.e. venting, hydrolysis and extraction takes place under optimum conditions in the respective vessels. The raw material is not destroyed during passage through the vessels but retains its original form and the cellulose contained therein remains substantially unaffected. The residue can therefore be reused, for example, in pulp production.

As already stated, the raw material is vented by the steam at a temperature of 100° C and at atmospheric pressure. In order to control these parameters, a suitable means is provided to measure the steam temperature in the venting vessel 7 and reaction vessel 24 to control the amount of steam flowing from the tank to the reaction vessel 24 and the venting vessel 7. Such a means includes a temperature sensor 120 (FIG. 2) for measuring the temperature in the venting vessel 7, a line 121 for transmitting a signal representative of the measured temperature and a controller 122 for receiving the signal. The temperature in the top zone of the reaction vessel 24 is also measured by means of a temperature sensor 123 and is also fed to the controller 122 via a line 124 and the line 121. This controller 122 produces a control signal according to the measured temperatures, which control signal is then fed via a signal line 125 to the valve 32 in the steam line 31. This valve 32 controls the amount of steam flowing out of the vessel 33 through the reaction vessel 24 and the venting vessel 7.

A means is also provided for maintaining a constant level of acid in the venting vessel 7 and the impregnating vessel 10. To this end, the level 130 of acid 101 in the venting vessel 7, which is always the same as the level 131 of acid in the screw conveyor, is detected by a level meter 132 and a representative signal is fed via a line 133 (FIG. 2) to a controller 134 which by way of a signal line 135 produces an appropriate control signal for the control of a valve 136 in the conduit 20 between the acid tank 21 and the housing 22 of the screw conveyor.

A suitable means is also provided for controlling the speed of the conveyor in the impregnating vessel 10 in dependence on the level of raw material in the reaction vessel 24. To this end, the level 137 of the column 102 of raw material in the reaction vessel 24 is measured radioactively by means of a device **138, 138*a* which produces a level signal which is fed via a line 139 to a controller 140. The controller 140, in turn, produces and emits a control signal via a signal line 141 to the screw conveyor drive motor 19 in order to control the speed of rotation of the motor 19.**

A means is also provided to control the hot water supply means independence on the level of hydrolysis product in the storage tank 48. To this end, the level of hydrolysis product in the storage tank 48 is measured by a sensor 142 and a representative signal is fed via a line 143 to a controller 144 which, by way of a signal line 145, produces a control signal for the control of the valve 58 in the line 57 between the hot-water tank 59 and the extraction vessel 41.

The speed of rotation of the removal means 66 is adjusted for a given apparatus capacity, i.e. raw material throughput. For this purpose, a controller 146 (FIGS. 1 and 4) is used to keep the removal means drive motor 70 at the value to which the speed has been set.

Referring to FIGS. 1 and 5, the level of the hot water in the extraction vessel 41 is determined by the level of the orifice of the overflow conduit 81. This level is adjustable by the presence of the flexible intermediate conduit 80. Thus, assuming full flow, the hot water level can be maintained constant at a given level.

Venting and reaction (hydrolysis) take place at about 100° C and atmospheric pressure. Under these conditions, hydrolysis is complete after about 30 to 40 minutes. The time required for the column of raw material to flow through the extraction vessel 41 is about 3 hours. The hot water fed to the extraction vessel 41 from the tank 59 has a temperature of about 90° C.

The apparatus is not restricted to the processing of xylan-containing raw materials, such as beech chips, for the production of xylose, but is, of course, also applicable to the production of other sugars, and generally to the production of sugars from hemicellulose-containing raw materials.

What is claimed is:

1. An apparatus for the continuous production of sugars from hemi-cellulose-containing raw materials comprising a venting vessel for receiving a flow of the raw material and steam;

an impregnating vessel below said venting vessel for impregnating the flow of raw material with acid;

a reaction vessel below said impregnating vessel for steam-heating the flow of the acid-impregnating raw material to hydrolyze the raw material;

a conveyor in said impregnating vessel for conveying the acid-impregnated raw material from said impregnating vessel to said reaction vessel; and an extraction vessel below said reaction vessel for passing hot water in counter-flow to the hydrolyzed raw material to extract a sugar from the hydrolyzed raw material and from a hydrolysis product of the hot water and extracted sugar.

2. An apparatus as set forth in claim 1 wherein said conveyor is a screw conveyor extending between a bottom zone of said impregnating vessel and a top zone of said reaction vessel on an inclined angle to convey the impregnated raw material upwardly from said bottom zone to said top zone.

3. An apparatus as set forth in claim 2 wherein a bottom zone of said reaction vessel and a top zone of said extraction vessel form an annular chamber wherein the speed of the upward flow of the hydrolysis product is less than the speed of sedimentation of the extracted sugar.

4. An apparatus as set forth in claim 3 which further comprises an overflow means in liquid-communication with said extraction vessel for maintaining a constant level of hot water in said extraction vessel.

5. An apparatus as set forth in claim 1 which further comprises a steam flow connection between a top zone of said reaction vessel and a bottom zone of said venting vessel.

6. An apparatus for the continuous production of sugars from hemi-cellulose-containing raw materials comprising a venting vessel for receiving a flow of comminated raw material containing hemi-cellulose;

first means for supplying steam into said venting vessel to penetrate into the pore system of the raw material;

an impregnating vessel below said impregnating vessel for receiving the acid-impregnated raw material;

second means for supplying steam into said reaction vessel to hydrolyze the raw material;

a conveyor within said impregnated vessel for conveying the acid-impregnated raw material from said impregnating vessel to said reaction vessel;

an extraction vessel below said reaction vessel for receiving the hydrolyzed raw material;

means for supplying hot water to said extraction vessel in counterflow to the flow of hydrolyzed raw material to extract a sugar from the hydrolyzed raw material and from a hydrolysis product of the hot water and extracted sugar; and a storage tank connected to said extraction vessel to receive and store the hydrolysis product.

7. An apparatus as set forth in claim 6 which further comprises a housing supporting said extraction vessel thereon, a removal means mounted on said housing below said extraction vessel to receive and remove the residue of raw material from said extraction vessel, means for supplying hot water to said removal means to entrain the residue of raw material for discharge, an outflow conduit for removing the entrained residue from said removal means, and means for separating the water and entrained residue for re-cycling of the water to said removal means.

8. An apparatus as set forth in claim 6 wherein said first means includes a steam tank and conduits connecting said steam tank with a bottom zone of said reaction vessel and said second means includes an annular chamber between said impregnating vessel and said reaction vessel, and conduits connecting said chamber with said venting vessel.

9. An apparatus as set forth in claim 8 which further comprises means for measuring the steam temperature in said venting vessel and said reaction vessel to control the amount of steam flowing from said tank to said reaction vessel and said venting vessel.

10. An apparatus as set forth in claim 6 which further comprises means for maintaining a constant level of acid in said venting vessel and impregnating vessel.

11. An apparatus as set forth in claim 6 which further comprises means for controlling the speed of said conveyor in dependence on the level of raw material in said reaction vessel.

12. An apparatus as set forth in claim 6 which further comprises means for controlling said means for supplying hot water in dependence on the level of hydrolysis product in said storage tank.

* * * * *

UNITED STATES PATENT AND TRADEMARK OFFICE

CERTIFICATE OF CORRECTION

PATENT NO. : 4,023,982

DATED : May 17, 1977

INVENTOR(S) : Hans H. Knauth

It is certified that error appears in the above-identified patent and that said Letters Patent are hereby corrected as shown below:

Column 1, line 8, change "realtes" to --relates--.
Column 1, lines 28-29, change "meterials" to --materials--.
Column 3, line 10, change "inpregnating" to --impregnating--.
Column 4, line 48, change "through" to --trough--.
Column 5, line 3, change "negataive" to --negative--.
Column 6, line 17, change "takes" to --take--.
Column 7, line 51, change "from" to --form--.
Column 7, line 43, change "impregnating" to --impregnated--.
Column 8, line 15, change "impregnating" (second occurrence) to --venting--.
Column 8, line 16, after "receiving" insert --and impregnating the flow of steam heated raw material with acid;
means for supplying acid into said impregnating vessel;
a reaction vessel below said impregnating vessel for receiving--.
Column 8, line 28, change "from" to --form--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*